US005311650A

United States Patent [19]

Goineau

[11] Patent Number: 5,311,650

[45] Date of Patent: May 17, 1994

[54] TEXTURIZING SYSTEM AND APPARATUS

[75] Inventor: Andre' M. Goineau, Spartanburg, S.C.

[73] Assignee: Milliken Research Corporation, Spartanburg, S.C.

[21] Appl. No.: 821,322

[22] Filed: Jan. 13, 1992

Related U.S. Application Data

[63] Continuation of Ser. No. 633,465, Dec. 24, 1990, abandoned.

[51] Int. Cl.[5] ..... D02J 1/22; B65M 51/08

[52] U.S. Cl. ..... 28/246; 28/240; 242/47.08; 242/47.09

[58] Field of Search ..... 28/240

[56] References Cited

U.S. PATENT DOCUMENTS

| | | | |
|---|---|---|---|
| 770,440 | 9/1904 | Owen | 19/287 |
| 1,702,969 | 2/1929 | Helland | 19/287 |
| 1,722,173 | 7/1929 | Bishop | 19/287 |
| 1,737,592 | 12/1929 | Kooistra | 19/287 |
| 1,898,085 | 2/1933 | Dreyfus et al. | 28/243 |
| 2,024,447 | 12/1935 | Hendrickson | 19/287 |
| 2,252,546 | 8/1941 | Blake | 19/287 |
| 2,639,486 | 5/1953 | McDermott | 242/47.09 |
| 3,651,631 | 3/1972 | Regelmann et al. | 57/55.5 |
| 3,723,709 | 3/1973 | Forshee . | |
| 4,319,447 | 3/1982 | Barron | 28/271 X |
| 4,341,063 | 7/1982 | Southerlin et al. | 28/271 X |
| 4,437,301 | 3/1984 | Eschenbach et al. | 28/271 X |

FOREIGN PATENT DOCUMENTS

| | | | |
|---|---|---|---|
| 298316 | 1/1989 | European Pat. Off. . | |
| 2906012 | 7/1979 | Fed. Rep. of Germany . | |
| 422614 | 4/1967 | Japan . | |
| 656260 | 8/1951 | United Kingdom | 19/287 |

*Primary Examiner*—Clifford D. Crowder
*Assistant Examiner*—Bibhu Mohanty
*Attorney, Agent, or Firm*—Earle R. Marden; Terry T. Moyer

[57] ABSTRACT

A method and apparatus to texture synthetic yarn in which the pin heater used in the drawing step of the system is moved periodically to spread the wear on the surface thereof. The pin heaters are mounted on a bar which is slid sideways by a periodically actuated cam member.

3 Claims, 2 Drawing Sheets

TEXTURIZING SYSTEM AND APPARATUS

This is a continuation of application Ser. No. 07/633,465 filed Dec. 24, 1990, now abandoned.

This invention relates generally to a method and apparatus to air texture continuous filament yarn which has been passed over a heater to enhance the drawing of the yarn prior to the texturing thereof.

In texturing systems where the yarn to be textured is drawn, it can be delivered over a heated pin to allow the synthetic yarn to be stretched or drawn. The constant passage of synthetic yarn over the pin causes extreme wear on the pin due to the abrasive characteristics of the yarn. This results in a considerable amount of downtime or lost production of the texturing machine, as well as the cost of replacement pins, since these pins have to be replaced periodically.

Therefore, it is an object of the invention to provide a method and apparatus to texture synthetic yarn which reduces the wear of the yarn pin heater resulting in reduced operating cost and increased efficiency.

Other objects and advantages of the invention will become readily apparent as the specification proceeds to describe the invention with reference to accompanying drawings, in which.

Figure 1:
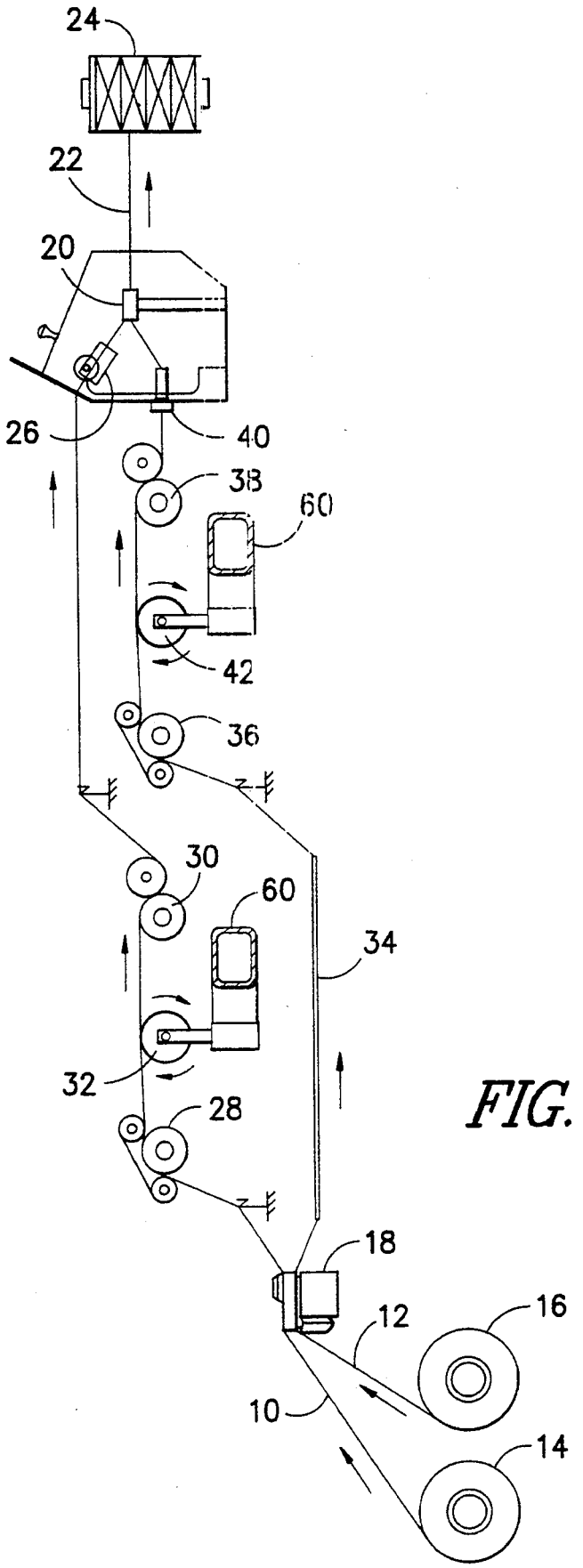
FIG. 1 is a schematic representation of the new texturing system.

Looking now to FIG. 1, the preferred process to air texture and blend two synthetic continuous filament yarns 10 and 12 is shown. It is understood that the herein-disclosed invention is not restricted to the specific yarn or number of yarns and the process disclosed is only representative. The yarns 10 and 12 are each 510 denier, 68 filament polyester yarns supplied, respectively, from the yarn packages 14 and 16. The yarns 10 and 12 are initially supplied to the yarn cutter 18 which, upon the detection of a machine malfunction, cuts the yarn being supplied. From the yarn cutter 18 the yarns 10 and 12 are supplied separately to the air texturing nozzle 20 to be textured and blended to form a 600 denier, 136 filament yarn 22 which is subsequently taken up on the take-up roll 24.

The yarn 10, from the yarn cutter 18, is delivered to the HEMAWET® or wetting device 26 after it has been drawn between the rolls 28 and 30 between which it is wrapped around the circular pin heater 32 which is maintained at a temperature of 140° C. ±2.5°. The roll 28 is driven at a speed of 790 r.p.m. and the roll 30 at a speed of 1343 r.p.m. to provide a draw ratio of 1.7.

Simultaneously with the yarn 10 the yarn 12 is guided upwardly by the guide tube 34 to the upper draw zone where the yarn 12 is drawn between the rolls 36 and 38 and delivered to the guide member 40. The yarn 12 is wrapped around circular pin heater 42, maintained at a temperature of 140°C. ±2.5°, and is drawn at a ratio of 1.7 since the roll 36 is driven at a speed of 1212 r.p.m. and the roll 38 at a speed of 2061 r.p.m.

The drawn yarn 10 is dampened in the Hemawet® 26 to enhance the blending of the yarn 10 with the yarn 12 from the guide member 40 in the air texturing jet 20 which is operated by air supplied at a pressure of about 150 p.s.i.

Figure 2:
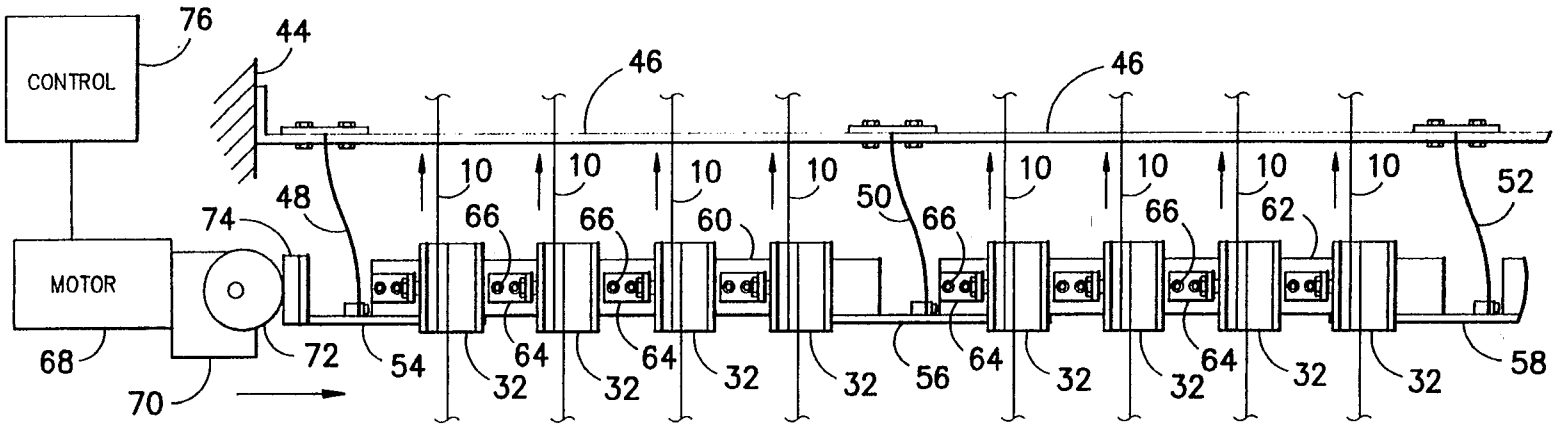
FIG. 2 shows the pin heaters of one of the yarns in the system shown in FIG. 1 in the outward position.
Figure 3:
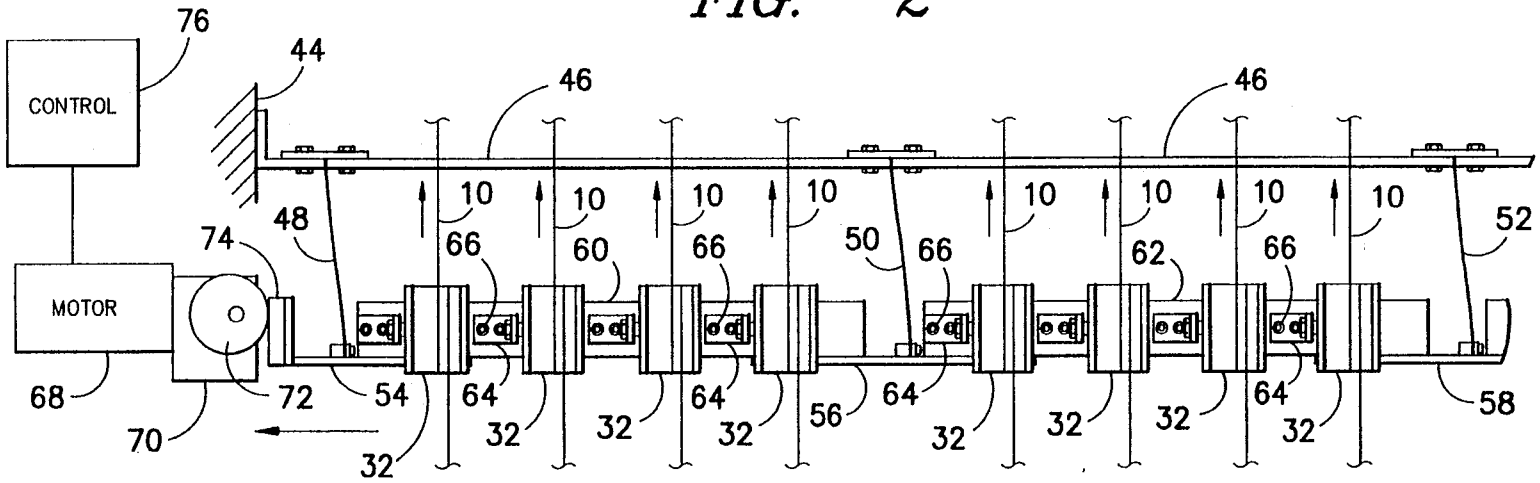
FIG. 3 shows the pin heaters of FIGS. 1 and 2 in the inboard position.

In a conventional texturing machine a plurality of positions are located side-by-side in the machine as indicated in FIGS. 2 and 3. Mounted on the frame of the machine 44 is an elongated beam support member 46 depending from which are spring steel members 48, 50, 52, etc. Connected to the bottom end of the members 48, 50 and 52 are pin heater support plates, respectively, 54, 56 and 58. Mounted on and between the support plates 54 and 56 is a rectangular support tube 60 and mounted between the support plates 56 and 58 is another rectangular support plate 62. As shown in FIGS. 2 and 3, the pin heaters 32, as well as 42, are mounted to the plates 60 or 62 by suitable brackets 64 and screws 66.

Mounted on one end of the frame of the machine 44 is a stepping motor 68 and gear box 70 which drives the eccentric cam 72. The cam 72 slidably engages a flange portion 74 on the support plate 54 to move or allow the movement of the support plate 54, as well as plates 56 and 58, along with the pin heaters 32 or 42. When the fixed pin heaters are moved in one direction or the other the point of contact of the yarn 10 or 12 on the surface of the heater is changed thereby moving the area of abrasion thereon by the yarn resulting in longer service life of the pin heater. In the preferred embodiment the controller 76 actuates the motor 68 for about one (1) second in every sixty (60) to rotate the cam 72 through an arc. The amount of movement of the cam 72 and the time of movement basically depends on the setting of the controller 76 by the operator.

It can readily be seen that movement of the pin heaters in one direction or the other will lessen the abrasion of the surface of any pin heater in any one spot by the yarn passing thereover. Since the abrasion is lessened, the pin heater can stay in service longer thereby increasing the efficiency of the machine and decreasing the down time and cost for replacement with new pin heaters.

Although the preferred embodiment of the invention has been described, it is understood that many changes may be made within the scope of the invention and it is desired that the invention be limited only by the scope of the claims.

I claim:

1. Apparatus to air texture and blend continuous filament synthetic yarns comprising: a texturing machine having a plurality of side-by-side positions, means supplying synthetic yarn to be textured to each position, a first drive roll at each position supplying each of the synthetic yarns to a separate draw zone, pin heater reciprocally mounted in each draw zone with its axis substantially parallel to the axis of said first drive roll, means operably associated with each of said draw zones to draw and texturize the synthetic yarn supplied to the respective draw zone, means to take up the blended yarn and means connected to said pin heaters to automatically and periodically move each of said pin heaters in a direction transverse to the path of travel of the yarn in the draw zone, means supplying at least two synthetic yarns to each position and a wetting means for one of each of said yarns is mounted downstream of the means to texturize said yarns.

2. Apparatus to air texture and blend continuous filament synthetic yarns comprising: a texturing machine having a plurality of side-by-side positions, means supplying synthetic yarn to be textured to each position, a first drive roll at each position supplying each of the synthetic yarns to a separate draw zone, pin heater reciprocally mounted in each draw zone with its axis substantially parallel to the axis of said first drive roll, means operably associated with each of said draw zones to draw and texturize the synthetic yarn supplied to the respective draw zone, means to take up the blended yarn and means connected to said pin heaters to automatically and periodically move each of said pin heaters in a direction transverse to the path of travel of the yarn in the draw zone, all of said pin heaters being mounted on a single support plate suspended from the texturing machine by flexible suspension means.

3. The apparatus of claim 2 wherein said support plate has an upturned flange on one end thereof and said machine includes an eccentric cam engaging said upturned flange and a motor to rotate said cam.

* * * * *